US006364633B1

(12) United States Patent
Kelly

(10) Patent No.: US 6,364,633 B1
(45) Date of Patent: Apr. 2, 2002

(54) INTERNALLY PORTED HYDRAULICALLY ACTUATED DOWN-HOLE PUMP

(76) Inventor: Melvin E. Kelly, 2742 Fair Oaks Cir., Odessa, TX (US) 79762

( * ) Notice: Subject to any disclaimer, the term of this patent is extended or adjusted under 35 U.S.C. 154(b) by 0 days.

(21) Appl. No.: 09/537,058

(22) Filed: Mar. 28, 2000

(51) Int. Cl.[7] ..... F04B 17/00
(52) U.S. Cl. ..... 417/375; 417/399; 417/401
(58) Field of Search ..... 417/375, 399, 417/401, 403, 404

(56) References Cited

U.S. PATENT DOCUMENTS

| | | | | | |
|---|---|---|---|---|---|
| 2,787,961 | A | * | 4/1957 | Chenault | 417/375 |
| 3,374,746 | A | * | 3/1968 | Chenault | 417/403 |
| 3,653,786 | A | | 4/1972 | McArthur et al. | 417/404 |
| 4,076,458 | A | * | 2/1978 | Jones | 417/46 |
| 4,202,656 | A | * | 5/1980 | Roeder | 417/404 |
| 4,406,598 | A | * | 9/1983 | Walling | 417/404 |
| 4,544,335 | A | * | 10/1985 | Roeder | 417/401 |
| 4,768,589 | A | * | 9/1988 | Roeder | 417/403 |
| 5,104,296 | A | * | 4/1992 | Roeder | 417/403 |
| 5,209,651 | A | | 5/1993 | Kelleher et al. | 417/404 |
| 5,494,102 | A | * | 2/1996 | Schulte | 417/403 |
| 5,651,664 | A | | 7/1997 | Hinds et al. | 417/172 |
| 5,667,364 | A | | 9/1997 | O Mara et al. | 417/151 |

* cited by examiner

*Primary Examiner*—Charles G. Freay
*Assistant Examiner*—Michael K. Gray
(74) *Attorney, Agent, or Firm*—Head, Johnson & Kachigian

(57) ABSTRACT

A hydraulically actuated down-hole pump formed as a vertically elongated tubular structure having an engine outer tube that receives a reduced external diameter engine cylinder providing an annular power fluid passageway there between with an engine piston in the engine cylinder, a production outer tube supported to a lower end of the engine outer tube, the production outer tube receiving a reduced external diameter production cylinder providing an annular production fluid passageway there between, a ported valve rod interconnecting the engine piston and production piston, an engine valve controlling the delivery of power fluid to the power cylinder and production valve controlling the passage of production fluid to the production cylinder, the annular passageways reducing the need for external pump seals.

5 Claims, 4 Drawing Sheets

INTERNALLY PORTED HYDRAULICALLY ACTUATED DOWN-HOLE PUMP

REFERENCE TO PENDING APPLICATIONS

This application is not related to any pending United States or international patent application.

REFERENCE TO MICROFICHE APPENDIX

This application is not referenced in any Microfiche Appendix.

BACKGROUND OF THE INVENTION

When a well is drilled from the earth's surface into an oil bearing formation, the oil may be forced to the earth's surface by formation pressure. However, when the formation pressure is insufficient to force the oil to the earth's surface, either due to an inherent low pressure formation or, when a formation has been produced for an extended period of time such that the formation pressure has diminished, it is then necessary to pump the oil from the formation to the earth's surface. Pumping of oil wells has historically been accomplished primarily through the use of sucker rod pumps in which a string of sucker rods is reciprocated within tubing extending from the earth's surface into the oil producing formation. At the bottom of the string of sucker rods is a reciprocated pump. To actuate the pump the sucker rods are vertically reciprocated. The constantly repeated reversal of stresses in reciprocated pumping operations results in fairly high wear rates and frequent failures.

To overcome problems inherent with reciprocated sucker rod pumps, down-hole fluid operated pumps have been developed. These pumps typically include a fluid operated pump motor that actuates a pumping mechanism. The most common type of down-hole fluid operated deep well pumps employ pump engines that reciprocate a pump piston. In some instances, the hydraulic fluid used to produce pump action is mixed with the production fluid to flow commingled back to the earth's surface. In some installations, a separate return line is employed so that the hydraulic fluid employed for pumping action is recirculated back to the earth's surface independently of the production fluid. While the latter type system works effectively, it requires parallel hydraulic operating fluid lines in addition to the production fluid passageway and thus the installation of this latter type of pump is more difficult. The most commonly employed hydraulically actuated down-hole pumps utilize the arrangement wherein power fluid is forced down a central tubing to actuate a reciprocating pump engine to force production fluid into an annular area between a casing and the power tubing to flow to the earth's surface and in which the spent power fluid is commingled with the production fluid. This system requires only concentric piping that is substantially easier to install than parallel piping.

A typical hydraulically actuated down-hole pump has a fluid powered motor that produces reciprocal action and a reciprocating pump with the motor piston and the pump piston in axial alignment and connected by a piston rod. A typical pump is in the order of 1.9" to 3.8" inches in diameter and from 6.5' to 25' feet or longer and is positioned in a bottom hole assembly of a well casing. The well casing is typically in the order of about $4^{1/2}$" to 9" inches in diameter and the tubing used to supply high pressure hydraulic fluid to actuate the pump may typically be from $1^{1/2}$" to $2^{1/2}$" inches in diameter. The produced fluid flows back to the earth's surface in the annular area between the interior of the casing and the exterior of the tubing.

A basic description of the operation and function of a bottom hole pump can be obtained from U.S. Pat. No. 2,081,227 entitled, "FLUID OPERATED DEEP WELL PUMP" that issued on May 25, 1937. This patent indicates that hydraulically actuated down-hole pumping has been used for at least sixty years and is an indication of the success of hydraulic down-hole pumping.

Hydraulically actuated pumps must be removed periodically from a well for repair of worn parts and replacement of seals. The life of a hydraulically actuated pump depends upon many factors, a primary one being the nature of the fluid being handled—that is, whether the fluid is inherently corrosive or includes entrained abrasive components such as sand.

In order to obtain more pumping power, especially for operation at greater depths—multi-engine pumps have been employed. For an example of a multi-engine pump reference may be had to U.S. Pat. No. 3,653,786 entitled, "FLUID OPERATED PUMP ASSEMBLY WITH TANDEM ENGINES" issued Apr. 4, 1972. In a pump of this design, two fluid powered motors are positioned in tandem, one above the other, with the motor pistons connected by an axially in-line piston rod. Some dual engine configurations require porting to the exterior of the pump to provide fluid paths around various components. This can result in larger diameter well casing requirements thereby increasing the expense of the installation. In addition, some multi-engine pumps require additional annual seals on the exterior of the pump for externally ported flow paths. These additional seals increase the cost of construction and impose additional maintenance expense.

For additional background information relating to hydraulically actuated down-hole pumps employing more than one pump piston, reference may be had to U.S. Pat. No. 5,209,651 entitled, "MULTIPLE ENGINE DEEP WELL PUMP" that issued on May 11, 1993; U.S. Pat. No. 5,651,664 entitled, ""FREE" COIL TUBING DOWNHOLE JET PUMP APPARATUS AND METHOD" that issued on Jul. 29, 1997; and U.S. Pat. No. 5,667,364 entitled, "DOWNHOLE HYDRAULIC PUMP APPARATUS HAVING A "FREE" JET PUMP AND SAFETY VALVE ASSEMBLY AND METHOD" that issued on Sep. 16, 1997.

BRIEF SUMMARY OF THE INVENTION

The present invention is a down-hole reciprocating hydraulic piston pump for use in oil wells. The pump of this invention is suitable for high volume deep well applications and is particularly adaptable for use in remote areas such as jungles, deserts, cold climates and so forth where space is limited and transportation is not readily available.

The pump to be described herein can be utilized in two basic systems. That is, in the first type of pumping system the pump can be employed as a fixed type pump meaning that it is physically attached to the lower end of a string of tubing suspended from the earth's surface, the tubing running in casing and having a packer at the lower end that receives the down-hole pump. In this type of fixed installation the tubing must be removed in order to replace or repair the down-hole pump. The second type of pumping system that can employ the pump of this invention is referred to as the free-pump system in which the pump is not installed at the lower end of a string of tubing but is introduced directly into tubing at the earth's surface, the pump moving down within the tubing to seat itself at the lower end of the tubing. By reversing the direction of fluid flow to force fluid in the well annulus up through the tubing, the pump can be hydraulically moved from its operating position back to the earth's surface.

When the pump of this invention is used in a fixed installation, no external seals are required. When used as a free style, only one seal, typically an O-ring, is required at the top of the pump and a metal-to-metal seal at the bottom of the pump. This compares with other designs, designs that use as many as six or more external seals.

The pump of this invention is a reciprocating hydraulic piston pump, double acting and balanced with two or more engine pistons and one or more production pistons. Power fluid is introduced to the down-hole pump through power tubing and is directed by the hydraulic valving in the engine to actuate the engine pistons.

Up stroke motion of the power pistons is produced by power fluid directed by valving through an annular area between an engine outer tube and an engine cylinder to the bottom of the engine pistons. The pistons are connected by rods, the lower engine connecting rod being hollow. As the pistons move up, spent power fluid is discharged from the upper side of the engine pistons through a hollow engine middle rod and ports to the top side of the engine pistons and discharge ports on an engine valve body to an exit where the fluid exits the piston into the annular area exterior of the well tubing. At the same time production fluid is taken in through production intake valving on the power side of the production pistons and discharged from the top side of the production pistons through discharge valving and to the production exit. The produced fluid and the spent power fluid are commingled and flow back to the earth's surface in the well annular area within the casing and exterior of the power tubing.

On the down stroke, power fluid is introduced through ports and an engine valve to the top of the upper engine piston and through an upper hollow engine rod to the top of the lower engine piston. Spent fluid as a result of the downward movement of the engine pistons is discharged from the lower side of the engine pistons into an annular area between the engine outer tubes and the outside of the engine cylinder through discharge ports. At the same time, the production piston or pistons, which are connected to the engine pistons by a metal rod, begin to move downward. Production is taken on in the top of the production pistons through intake production valves and through the annular area between the pump and an outer tube and the outside of the pump end cylinder and through a ported lower plug. Production fluid is discharged from the bottom of the production piston through the discharge production valve assembly.

The length of the pump stroke is controlled by a ported rod which is located on the top of the upper engine piston. Grooves in a valve rod direct power fluid to the engine valve which directs power fluid to the top or bottom of the engine pistons according to the position of the pistons to cause the pistons to vertically reciprocate.

A better understanding of the invention will be obtained from the following description and claims, taken in conjunction with the attached drawings.

DESCRIPTION OF THE DRAWINGS

FIGS. 1–7 are each a segment of a pump taken in vertical sequence from top to bottom.

FIG. 8 is an elevational cross-sectional view of the lower portion of a well casing showing a power tubing suspended within the casing and showing diagrammatically, at the lower end of the power tubing, a pump that employs the principles of this invention in which the pump is used in the fixed pump system, that is, with the pump secured at the bottom end of the tubing and in which the tubing is removed in order to repair or replace the bottom hole pump. Whereas FIGS. 1–7 show a cross-sectional view exemplifying the details of construction of a pump, FIG. 8 shows the pump in diagrammatic form.

DETAILED DESCRIPTION OF A PREFERRED EMBODIMENT

Figure 1:
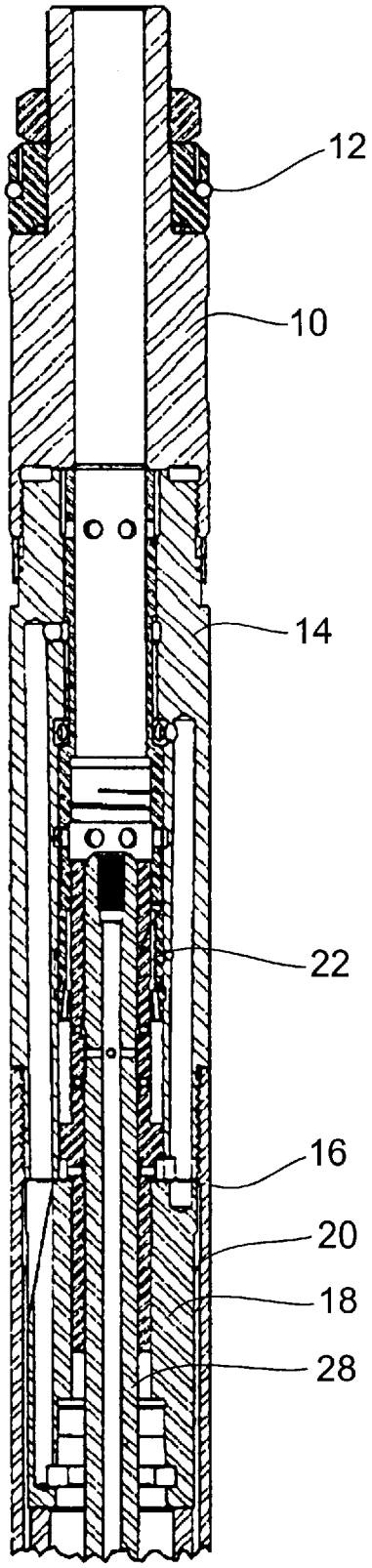
FIGS. 1–7 are each partial vertical cross-sections of a down-hole hydraulically actuated pump of this invention as employed in a free-pump system, that is where the pump can be circulated hydraulically in and out of its down-hole position.
Figure 2:
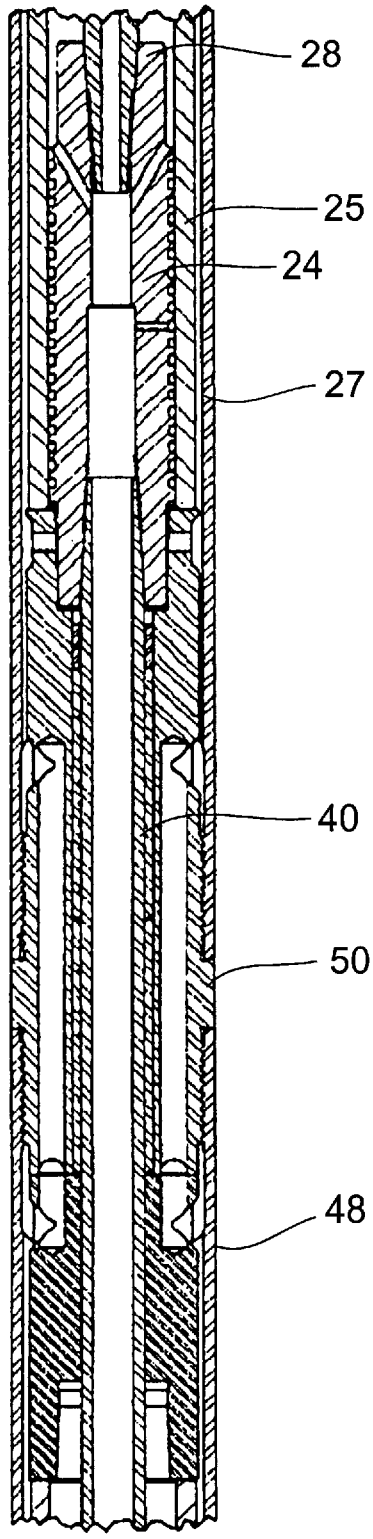
Figure 3:
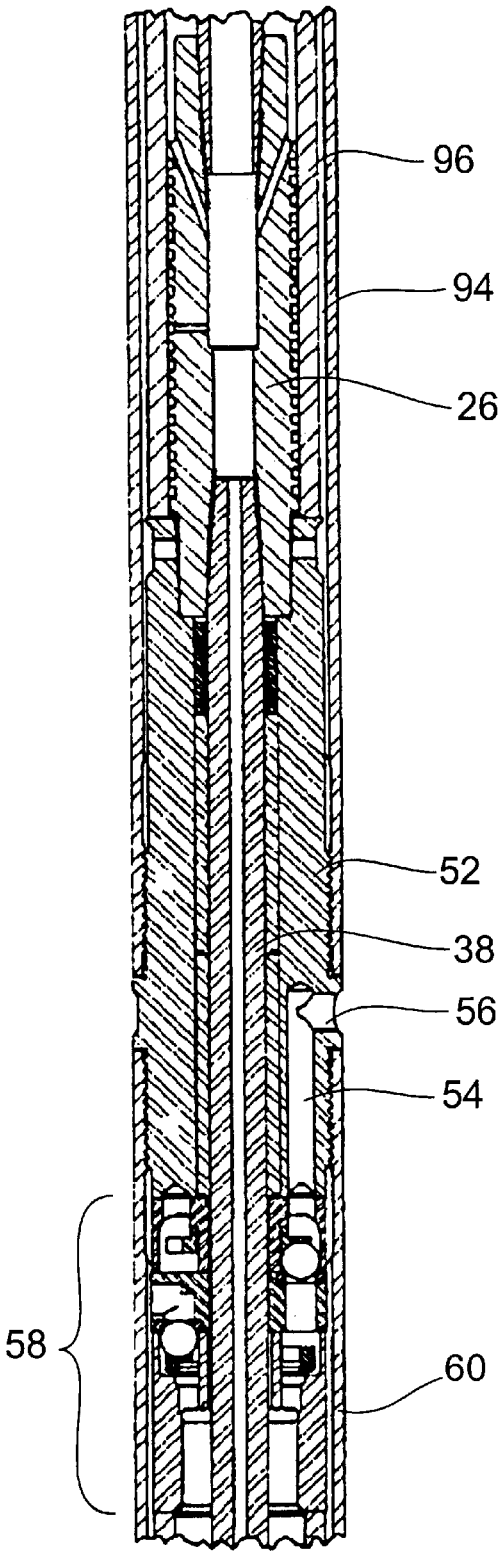
Figure 4:
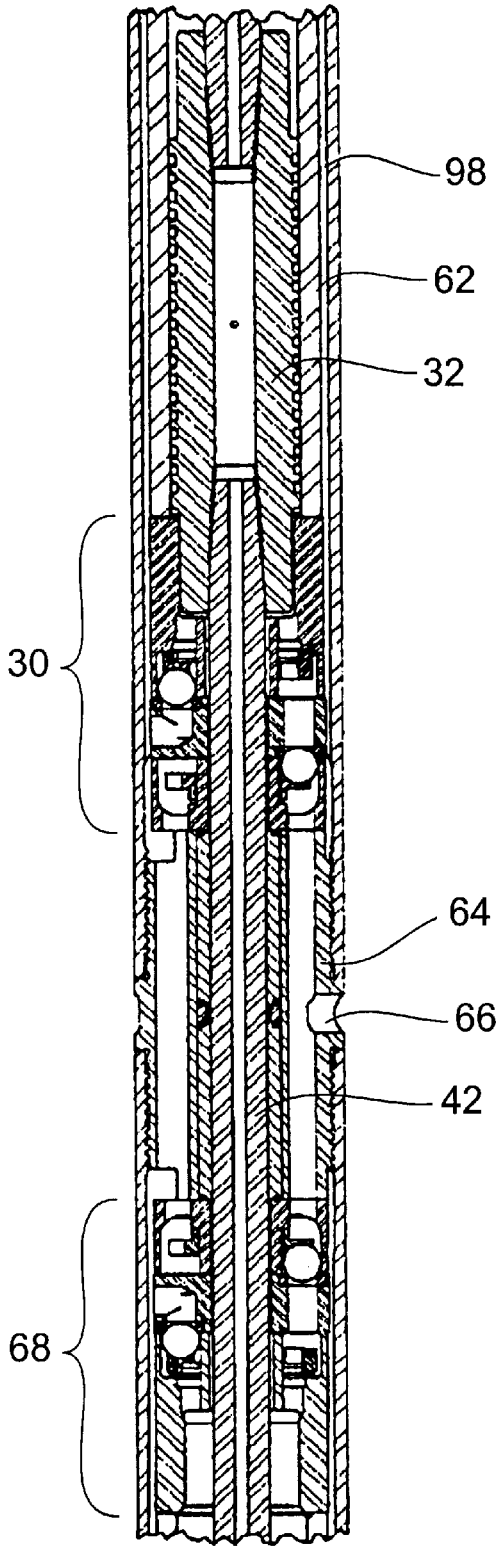
Figure 5:
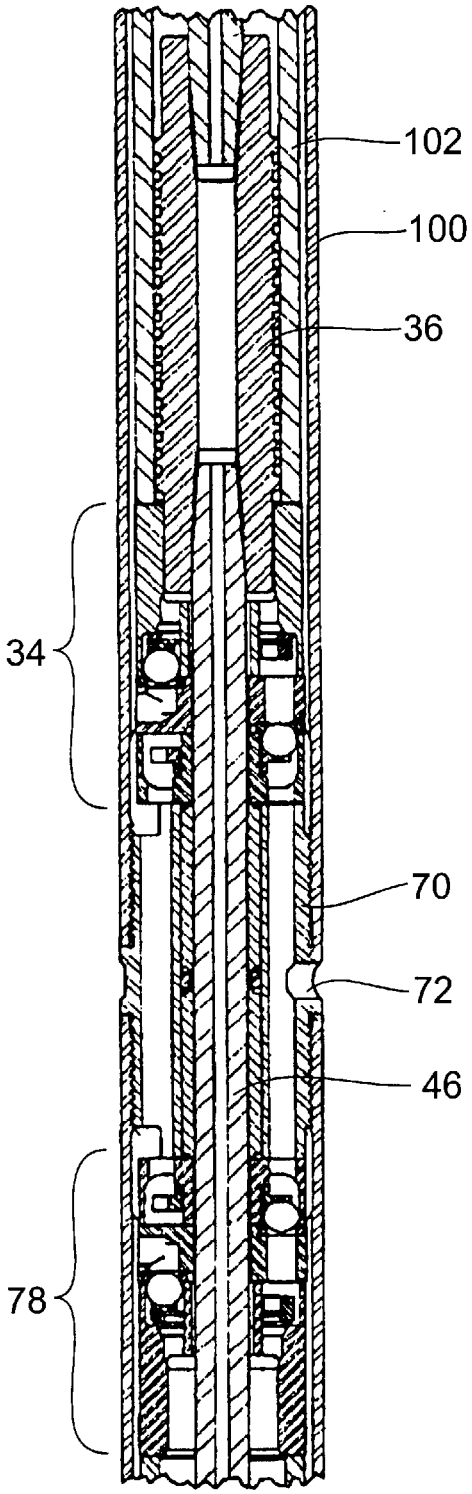
Figure 6:
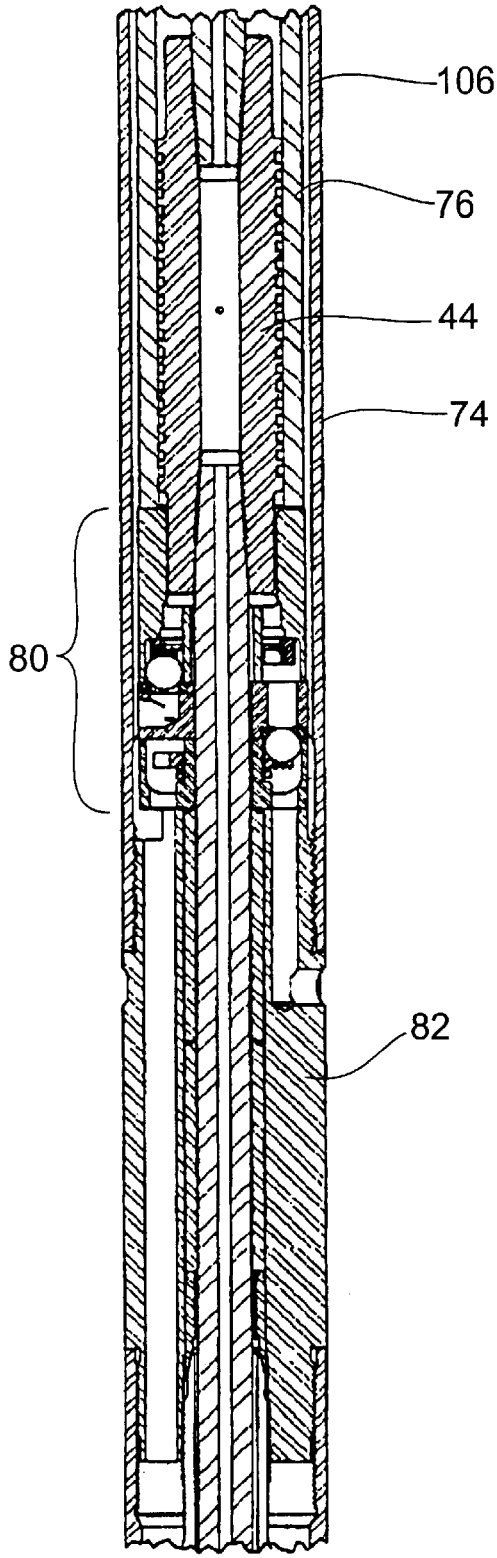
Figure 7:
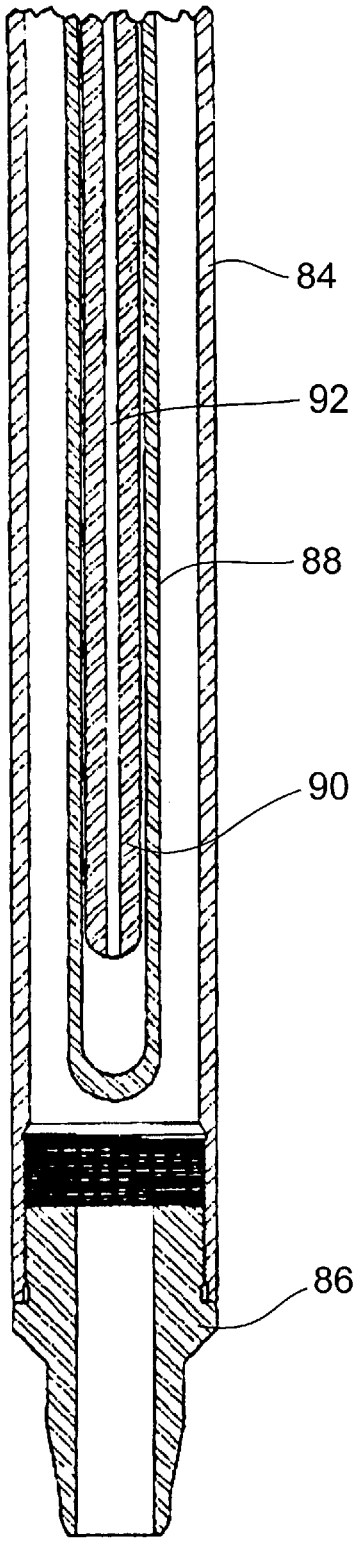

Referring first to FIGS. 1–7, an embodiment of a pump that includes the principles of this invention will be described as the pump is exemplified as a free-pump, that is a pump that can be installed and removed from an operating location adjacent the bottom of an oil well by hydraulic fluid flow. The pump illustrated in FIGS. 1–7 is positioned in a well utilizing the well-known technique of first installing casing and within the casing a string of tubing is installed, both the casing and the tubing being connected to a wellhead (not shown) at the earth's surface. Power fluid is injected under high pressure at the earth's surface, the power fluid traveling down the interior of the power fluid tubing to actuate the bottom hole pump and the commingled spent power fluid and fluid produced from the formation is carried by way of the annular area between the exterior of the power tubing and the interior of the casing to the earth's surface. With this type of pumping system a portion of the returning fluid is recirculated for use as power fluid and the excess fluid in production from the well. Since the technique for equipping a drilled oil well for production utilizing a down-hole hydraulic pump is well-known in the industry and has been practiced for many years, this background information is not illustrated. Instead, FIGS. 1–7 show in vertical sequence cross-sectional portions a hydraulically actuated bottom-hole pump that can be positioned in tubing that has been installed within casing in a well, the tubing typically having an installation shield (not shown) down through which a major portion of the length of the pump extends. The pump includes at its upper end as illustrated in FIG. 1, an upper fitting member 10 that supports on its external surface a seal 12 that is received within a shoe that is secured to a casing, the shoe and casing are not shown since they are well-known in the petroleum industry.

Secured to the lower end of upper fitting member 10 is an adapter fitting member 14 that is externally threaded at its lower end and receives an internally threaded upper end of an engine outer tube 16. Received within engine outer tube 16 is an engine cylinder 18. Between the exterior of engine cylinder 18 and the interior of engine outer tube 16 is annular area 20.

Power fluid is directed to the pump through the interior power tubing and the interior of upper fitting member 10 and adapter 14 to a hydraulic valve 22 which is also called an "engine valve", and is located at the top of the pump. Power fluid is directed by valve 22 through the annular area 20 between the engine outer tube 16 and engine cylinder 1 8 to the bottom of both an upper engine piston 24 and a lower engine piston 26, the lower engine piston being seen in FIG. 3. Lower engine piston 26 is connected to upper engine piston 24 by means of a ported valve rod 28. Upper engine piston 24 operates in an upper engine cylinder 25 positioned within upper outer tube 16. The diameter of engine cylinder 25 is less than the internal diameter of outer tube 16 providing an annular passageway 27.

As pistons 24 and 26 move up, spent power fluid is discharged from the upper side of the engine pistons through the interior of ported valve rod 28 and to ports on the top side of the engine pistons and through discharge ports on the engine valve body to the exterior of the pump.

At the same time, production fluid is admitted through an upper production intake valving 3 0 below an upper production piston 32 and through a middle production intake valving 34 located below a middle production piston 36. An upper ported pump rod 38 interconnects upper and middle production pistons 32 and 36.

As the upper engine piston 24 and lower engine piston 26 which are connected together by an engine piston rod 40, move to their upward positions hydraulic valve 22 is actuated so that power fluid is introduced to the top of the power pistons, thereby initiating a down stroke.

Upper production piston 32 and middle production piston 36 are connected by an upper ported pump rod 38. In addition to upper production piston 32 and middle production piston 36 there is a lower production piston 44. A lower pump rod 46 extends from middle production piston 36 to lower production piston 44.

Positioned between upper engine outer tube 16 and a lower engine outer tube 48 is an externally threaded coupling block 50. The lower end of lower engine outer tube 48 is connected to an externally threaded transition coupling block 52 that essentially separates the upper engine compartments from the lower pumping compartments. Formed in transition coupling block 52 is a passageway 54 that communicates with an upper production exit 56.

An intake valve assembly generally indicated by the numeral 58 is positioned below upper production exit 56 and between lower engine piston 26 and upper production piston 32. The intake production valve assembly 58 permits the upward flow of produced fluid as moved by upper production piston 32 but prevents downward flow of production fluid into the pump.

Extending downwardly from transition coupling block 52 is an upper pump outer tube 60 that houses an upper pump barrel 62 that receives upper production piston 32.

Affixed to the lower end of upper pump outer tube 60 is an externally threaded block 64 that has an intermediate production exit 66. Below exit 66 is an intake valve assembly generally indicated by the numeral 68 that functions like the intake valve assembly 58.

Secured below coupling block 64 is a coupling block 70 having a lower production exit 72. Extending downwardly from coupling block 70 is a lower pump outer barrel 74 that houses a lower pump cylinder 76 that receives lower production piston 44. Above production piston 44 within the lower pump outer barrel 74 is a discharge valve assembly generally indicated by the numeral 78 that controls the passage of fluid upwardly within the pump for discharge out through lower production exits 72. Positioned below the lowermost production piston 44 is an intake valve assembly generally indicated by the numeral 80.

Attached to the lower end of lower pump outer barrel 74 is a lower plug 82 that has, affixed to its lower end, a tubular extension 84 terminating in a bottom shoe member 86. Received within tubular extension 84 is a balance tube 88 that is closed at its lower end. Telescopically and reciprocally received within balance tube 88 is a lower rod 90 having an axial opening 92 therethrough.

As has been previously described, between the exterior of engine cylinder 18 and the interior of engine outer tube 16 is an annular area 20 through which fluid flows. In like manner, there is an annular area 94 between the exterior of lower engine cylinder 96 and lower engine outer tube 48; an annular area 98 between upper pump barrel 62 and upper pump outer tube 60; an annular area 100 between middle pump barrel 102 that receives middle production piston 36 and middle pump barrel outer tube 104; and an annular area 106 between lower pump cylinder 76 that surrounds lower production piston 44 and lower pump outer barrel 74. These annular areas provide flow passageways within the pump to thereby assist in eliminating the need for multiple external seals as is common with many types of hydraulically operated down-hole pumps.

By making use of a pump exterior defined by a series of axially supported outer tubes 16, 48, 60, 74 and 104 having therein reduced external diameter cylinders 25, 62, 76, 96 and 102, annular passageways 20, 94, 98, 100 and 106 are formed for internal flow within the pump. These internal annular flow passageways are combined with ported pump rods 28, 38, 40 and 46 so that both power fluid flows and production fluid flows are confined essentially within the pump thereby by eliminating the plurality of external seals required on most comparable pumps.

While FIGS. 1–7 illustrate segments of a hydraulically actuated down-hole pump having two power cylinders, each with a power (engine) piston therein, and three production cylinders, each with a production piston therein, the invention is not so limited. Only a single engine piston and a single production piston may be employed or, more commonly, two engine pistons along with one or two production pistons.

The invention as illustrated in FIGS. 1–7 is a free style pump in which the pump can be positioned into or extracted from the lower end of a bottom- hole casing/tubing system by circulation of hydraulic fluid and in which the pump seals at the lower end thereof at bottom shoe member 86 and at the upper end thereof by a seal, such as an O-ring seal 12. The pump design does not require intermediate seals between the top and bottom portion of the pump as is frequently required with existing pumps in present commercial use.

Figure 8:
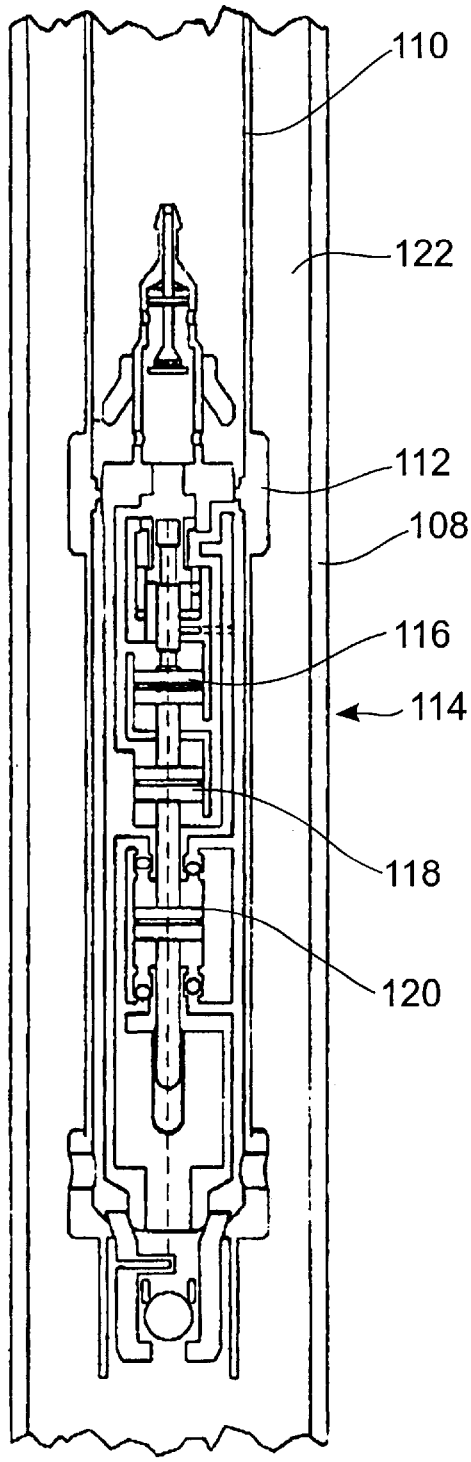

FIG. 8 is a diagrammatic representation of the pump of this invention of the fixed type. That is, in FIG. 8, a casing 108 that extends from the earth's surface into a producing formation receives a string of tubing 110 that has at the lower end thereof a seal collar 112. A down-hole hydraulically operated bottom-hole pump is generally indicated by the numeral 114, the pump being secured at its upper end portion by the seal collar 112. The pump includes first and second power pistons 116 and 118 that actuates a single production piston 120 that is diagrammatically representative of the pump of this invention. Hydraulic fluid pressures forced down through the interior of tubing 110 actuates power pistons 116 and 118 to in turn vertically reciprocally displace production piston 120 to draw fluid from the producing zone, the fluid being forced back to the earth's surface in the annular area 122 between the exterior of tubing 110 and the interior of casing 108. The fixed type pump diagrammatically illustrated in FIG. 8 does not require any external seals, however, the pump includes the design features of the free type pump that has been described in detail with reference to FIGS. 1–7.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A hydraulically actuated down-hole pump comprising:

a vertically elongated structure formed of a plurality of axially supported outer tubes, each outer tube being internally threaded at each end, externally threaded coupling blocks interconnecting said outer tubes, at least one of said outer tubes being an engine outer tube;

an engine cylinder coaxially received within said engine outer tube and of external diameter less than said engine outer tube providing an annular power fluid passageway therebetween;

an engine piston within said engine cylinder;

one of said outer tubes being a production outer tube in axial alignment with and connected to a lower end of said engine outer tube;

a production cylinder coaxially received within said production outer tube and of external diameter less than said production outer tube providing an annular production fluid passageway therebetween;

a production piston received within said production cylinder;

a ported valve rod interconnecting said engine piston and said production piston;

an engine valve controlling the delivery of power fluid to said power cylinder to actuate said power piston; and a production valve controlling the passage of production fluid to said production cylinders, power fluid flowing internally within the pump through said annular power fluid passageway and production fluid flowing internally within said pump through said annular production fluid passageway.

2. A hydraulically actuated down-hole pump according to claim 1 including a plurality of said engine outer tube, axially arranged in series relationship, each having an engine cylinder coaxially received therein, said engine cylinders being of external diameter less than said engine outer tubes providing a plurality of annular hydraulic fluid passageways there between, and a power piston received in each power cylinder, and power pistons being interconnected by ported valve rods.

3. A hydraulically actuated down-hole pump according to claim 1 including a plurality of said production outer tubes axially arranged in series relationship, each having a production cylinder coaxially received therein, said production cylinders being of external diameter less than said production outer tubes providing a plurality of annular hydraulic fluid passageways there between, and a production piston received in each production cylinder, said production pistons being interconnected by ported pump rods.

4. A hydraulically actuated down-hole pump according to claim 1 including;

a balance tube coaxially downwardly extending from a lower end of said production outer tube serving to capture power fluid therein;

an internally ported lower rod coaxially and reciprocally received within said balance tube, an upper end of said lower rod being attached to a lower end of said production piston, said lower rod being thereby reciprocated within power fluid within said balance tube and serving to balance the pump.

5. A hydraulically actuated down-hole pump according to claim 1 wherein said elongated tubular structure having an engine tube and having an engine cylinder, engine piston, production outer tube production cylinder, production piston, ported valve rod, engine valve and production valve therein is moveable from the earths surface to a down-hole pumping position and from the down-hole pumping position back to the earth's surface by the force of fluid flow.

* * * * *